US007025192B2

(12) United States Patent
Høeg et al.

(10) Patent No.: US 7,025,192 B2
(45) Date of Patent: Apr. 11, 2006

(54) DEVICE FOR TURNING OBJECTS

(75) Inventors: Bendt Jensen Høeg, Galten (DK); Torben Brander Nedergaard, Ronde (DK)

(73) Assignee: Tetra Laval Holding & Finance S.A., Pully (CH)

( * ) Notice: Subject to any disclaimer, the term of this patent is extended or adjusted under 35 U.S.C. 154(b) by 0 days.

(21) Appl. No.: 10/487,050

(22) PCT Filed: Aug. 8, 2002

(86) PCT No.: PCT/DK02/00528

§ 371 (c)(1),
(2), (4) Date: Aug. 13, 2004

(87) PCT Pub. No.: WO03/018406

PCT Pub. Date: Mar. 6, 2003

(65) Prior Publication Data

US 2005/0040010 A1 Feb. 24, 2005

(30) Foreign Application Priority Data

Aug. 17, 2001 (DK) ..... 2001 01227

(51) Int. Cl.
*B65G 47/24* (2006.01)

(52) U.S. Cl. ..... 198/375; 198/402; 198/377.02

(58) Field of Classification Search ..... 198/402, 198/404, 410, 411, 413, 375, 377.02, 377.06, 198/377.1, 377.01
See application file for complete search history.

(56) References Cited

U.S. PATENT DOCUMENTS 1,325,527 A * 12/1919 Mingle ..... 198/377.02
2,672,267 A * 3/1954 Menning et al. ..... 198/375
3,933,236 A * 1/1976 Aterianus et al. ..... 198/377.02
3,961,705 A * 6/1976 Suciu ..... 198/402
4,694,637 A 9/1987 Bech et al.
4,890,717 A * 1/1990 Kane ..... 198/403
4,912,415 A 3/1990 Krener et al.
5,261,520 A * 11/1993 Duke ..... 198/375
6,006,891 A 12/1999 Iwano et al.
6,267,222 B1 * 7/2001 Sardo ..... 198/377.02
6,293,387 B1 * 9/2001 Forster ..... 198/377.02

(Continued)

FOREIGN PATENT DOCUMENTS

EP 0 092 093 A1 10/1983

(Continued)

*Primary Examiner*—James R. Bidwell
(74) *Attorney, Agent, or Firm*—David S. Safran

(57) ABSTRACT

The invention relates to an object turner or a turning apparatus (4) for end-turning of e.g. ice-cream cones (22) after selective deflection of the objects (22) from an object conveyor (2) on which the objects are placed lying in horizontal trays (6). The novelty of the turning apparatus (4) according to the invention is that the turning apparatus (4) has selection means, which makes the turning process selective, and means ensuring that the process operates in parallel and synchronously with the object conveyor (2). The selected objects (22) are forwarded into a turning unit (8), where the object (22) is end-turned around a horizontal axis (38), and returned onto the object conveyor (2) in the same tray (6) previously occupied by the object. Such a turning apparatus (4) makes it possible for objects (22) to be end-turned in a predetermined pattern of e.g. all objects, every second or third object. The turning apparatus (4) shows a high level of reliability and at the same time gentle processing of the objects (22). The turning process is carried out quickly, and the apparatus (2, 4) typically has a capacity of 300 to 600 objects/minute.

10 Claims, 5 Drawing Sheets

U.S. PATENT DOCUMENTS

Figure 1:
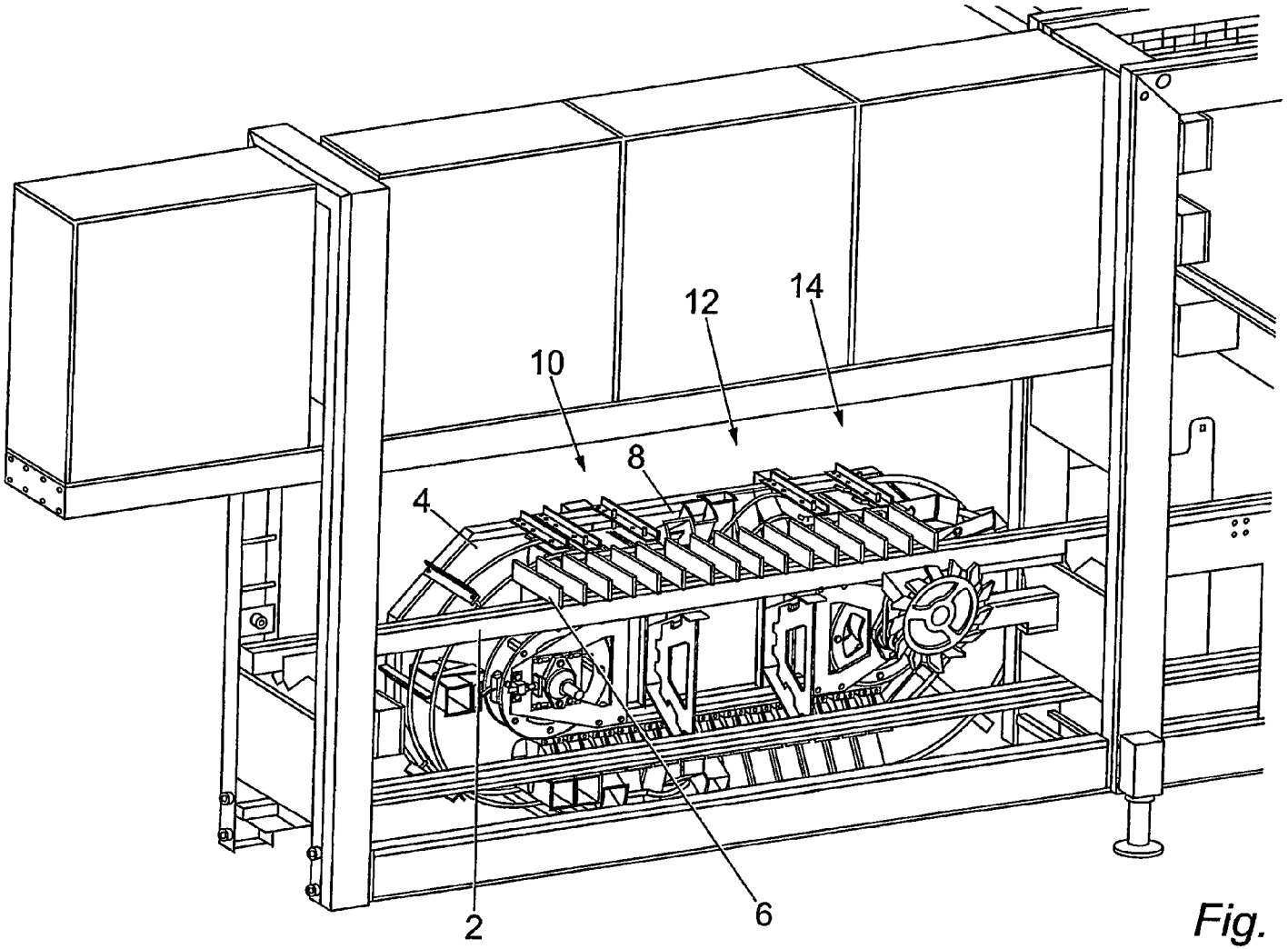

| | | | |
|---|---|---|---|
| 6,508,351 | B1 | 1/2003 | Christoffersen et al. |
| 6,536,599 | B1 | 3/2003 | Nielsen |

FOREIGN PATENT DOCUMENTS

| | | | |
|---|---|---|---|
| EP | 0 111 953 | A1 | 6/1984 |
| EP | 0 340 502 | B1 | 11/1989 |
| EP | 0 396 979 | A1 | 11/1990 |
| EP | 0 698 569 | A1 | 2/1996 |
| FR | 2 273 714 | | 1/1976 |
| WO | WO 82/03209 | A1 | 9/1982 |
| WO | WO 99/57016 | A1 | 11/1999 |
| WO | WO 00/48909 | A1 | 8/2000 |

* cited by examiner

DEVICE FOR TURNING OBJECTS

Turning apparatus for end-turning of objects, e.g. ice-cream cones or ice lollies, after selective deflection of the objects from an object conveyor, on which the objects are placed lying in horizontal trays.

It is well known that in order to achieve optimal utilisation of packaging, it is necessary to pack the objects compactly. Often, objects are packed in such a manner that they practically engage with each other, which means that they take up as little space as possible. A classical example is the old wooden beer cases, in which the bottles were layered, and where each layer lay with bottlenecks alternating one way or the other. When packing for in stance ice-cream cones, the same problem exists, since the ice-creams can be packed much closer due to their cone shape, if about half of the ice-creams in a carton are end-turned. Previously, such packing operation was carried out manually and later by machines, but with increasing demands for manufacturing and packing speed as well as low price, these methods are no longer up-to-date or a economical solution.

Obviously, automatic object grippers are known in the industry, and could very well be controlled to carry out selective turning of objects, either for further processing or for packing. However, these solutions are mechanically complicated and require a high degree of maintenance. Furthermore, these solutions do not offer any particular and necessary gentleness to the object.

It is the object of the invention to provide a method and a controllable apparatus for selective end-turning of objects, preferably industrially manufactured ice-creams, coned ice-creams and "Ball Type Cones" (ice-cream cones with a rounded top), in a gentle and safe manner prior to packing in cartons in order to obtain optimal compact packing.

The novelty of a turning apparatus according to the invention is that the apparatus has selective means which makes the turning process selective, and means ensuring that the process proceeds in parallel and synchronous with the object conveyor, on which objects are forwarded in object trays, and where the selection means selects the objects and forward these objects separately across a turning unit, where the objects and associated means are turned in the orthogonal plane of the direction of movement about a horizontal axis, which is parallel with the object conveyor and by the use of delivery means are delivered back on the object conveyor, preferably in the same object tray as the object previously were in.

The turning apparatus is as previously mentioned provided with the selection means which makes it possible to end-turn the objects in a predetermined pattern, for instance all objects, every second or every third object. The turning process is carried out in parallel with an object conveyor, and the turning units cooperate with the conveyor in such a manner that the turning process is carried out synchronously with and at the same speed as the object conveyor.

The turning apparatus comprises an essentially traditional pulling station that drives a number of turning units synchronously in relation to parallel running object trays on a conveyor. The turning units run in a closed circuit and comprise an adjusted number of units.

The turning apparatus works in such a manner that the object is received, end-turned and returned successively. This in fact means that the apparatus is divided into three sections, namely a receiving section, an end-turn section and a returning section. These three fictions are all carried out gently and quickly, while the turning apparatus is coupled, and the entire apparatus typically has a capacity of 300 to 600 objects/minute. It is therefore a necessity that the apparatus has a great reliability as well as a gentle handling of the objects. This is achieved by letting the turning process take place over a predetermined distance where the turning unit turns the object in a continuous movement simultaneously with conveying the object forward adjacent the tray in which the object was.

From the object trays of the conveyer, a selective and gentle "sweeping, pushing or deflection" is carried out on the objects into the turning tubes at the receiving section. This "sweeping" may be achieved by a transverse band on which means are mounted, which may be adjusted to different selection patterns depending on how the end-turning pattern should be.

This kind of sweeping is commonly known within the art and will not be described in detail.

Hereafter, the object trays as well as the turning units are conveyed in parallel through the turning section, where the turning units are guided for end-turning by means of a guide rail. In the event that not all of the objects are to be turned, a number of empty turning units will be present, which has no influence on the capacity.

The returning of the objects to the conveyor takes place in the returning section by means of air under high pressure and an air flow, which by an adapted pressure and air flow quickly drive the object out of the turning unit. However, the use of air is not a condition for operation of the apparatus, but it is necessary with a quick and gentle returning, since 6 to 10 objects/second must be returned.

In a preferred embodiment of the invention, the turning apparatus may comprise a number of turning units, each comprising a turning tube, where the turning tube is mounted in a console in points which are displaced in relation to the centre of gravity of the tube, and where the tube is 360° rotatable around its own revolving axis.

A turning unit consists of a turning tube and a console part, where the console part consists of a foot suitable for retaining the conveying means of the pulling station, and two support arms which extend from the sides of the foot for the retention of a bottom plate that ensures that the object does not leave the turning tube during the turning process. From the console—in this model from the ends of the foot—two further tube holding arms extend and connect the console and the turning tube by means of a mounting.

At the receiving section, a stationary mounting plate is mounted at the end of the turning tubes, and may be made of a soft material. This plate is necessary in order to prevent the object from sliding though the turning tube and out onto the other side. At the same time, the soft plate ensures a gentle reception of the object in the turning tube. Once the object has been guided into the turning tube, the tube is guided for end-turning as mentioned, whilst the turning units are forwarded synchronously with the object conveyor. In the turning section, the objects rest against a bottom plate that is fixed to the turning unit. The bottom plate is fixed to the console and to the support arms protruding from the console, and is formed with a shape corresponding to the circular arc described by the turning tube when it is rotated around its rotation axis. Hereafter, the object is returned to the same object tray that it previously occupied, with the difference that the object is now end-turned.

In order to avoid problems at the receiving section, the turning tube has is provided with a funnel-shaped receiving end. The turning tube is suspended in a bearing that is displaced relative to the centre line of the tube in such a manner that the bottom of the tube is under the level of the object tray when an object is received. Moreover, in order to ensure a safe return, a tapered delivery end is provided. Moreover, the displaced suspension ensures a certain distance to the bottom of the object tray at the returning. These precautions ensure that the object is not retained by a protruding edge or the like, and thereby a high reliability of operation is ensured with only minimal risk of squeezing an object or the like.

The turning apparatus is designed in such a manner that the rotation of each turning tube is controlled by fixed guide rails, which end-turn the tube after it has left the receiving section and before it enters a delivery section, wherein the turning tube is guided to an upwards inclination immediately after passage of the delivery section, and is moreover subjected to rotation back to the initial position prior to return to the receiving section.

Once the turning tube is empty, the guide rails ensure that the tube is inclined slightly upwards and thereby away from the object trays on the conveyor. Hereby, it is achieved that no squeezing conflict between the turning tubes and the object trays can take place when the object trays are free from the turning apparatus.

As soon as the turning unit is emptied, it must be returned to the receiving section. During this return, the tube is maintained in an inclined position that, which ensures that potential objects that are not lead out automatically fall out. In other words, the turning apparatus is self-emptying if an object unintendedly is not returned to the object tray. Immediately before renewed filling of turning tube, it is pivoted back to horizontal so that the receiving unit again faces in the right direction. During the entire cycle, the turning tube is guided by guide rails ensuring that the tube has the intended orientation at all times.

Figure 2:
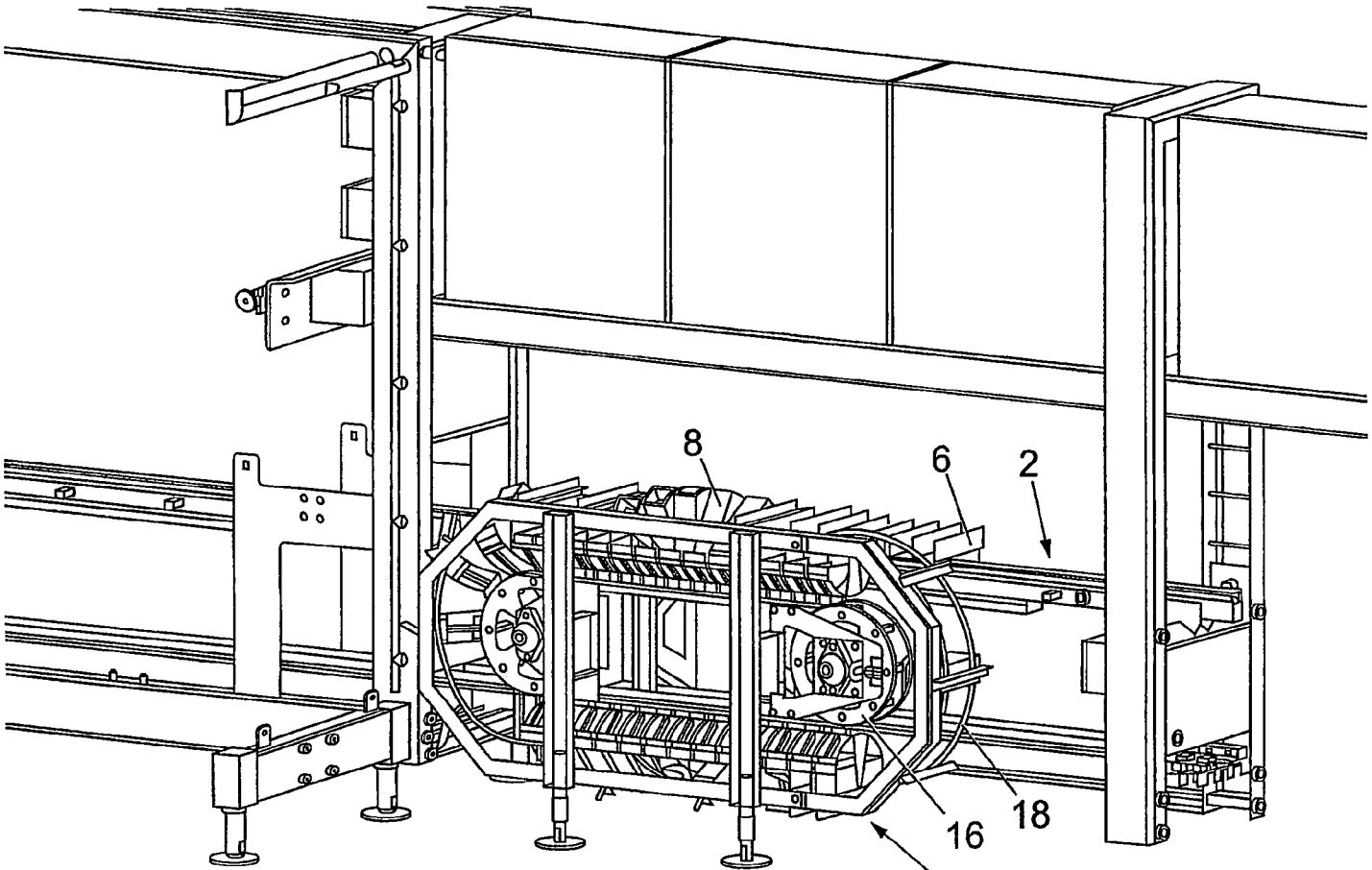
Figure 3:
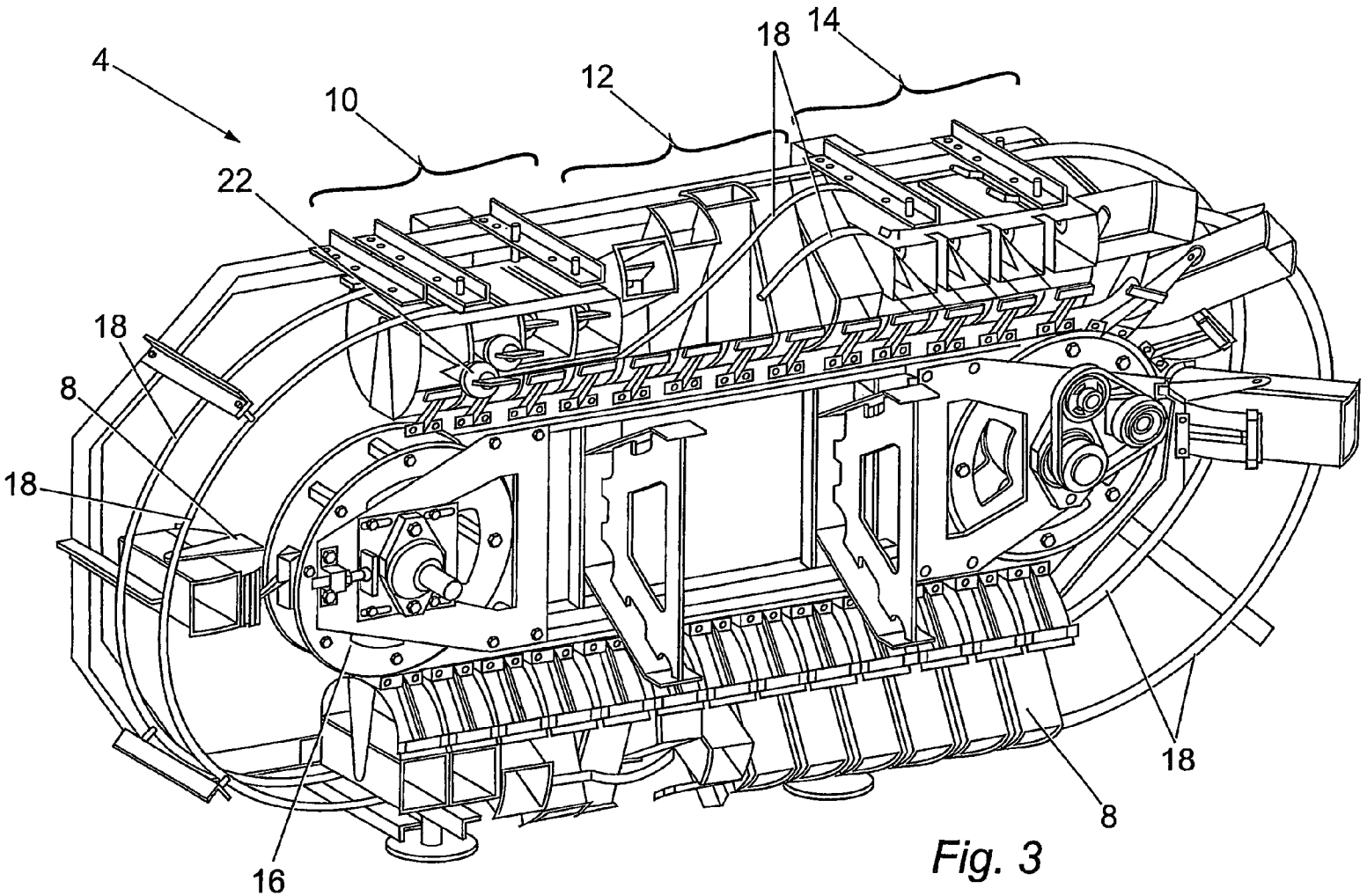
Figure 4:
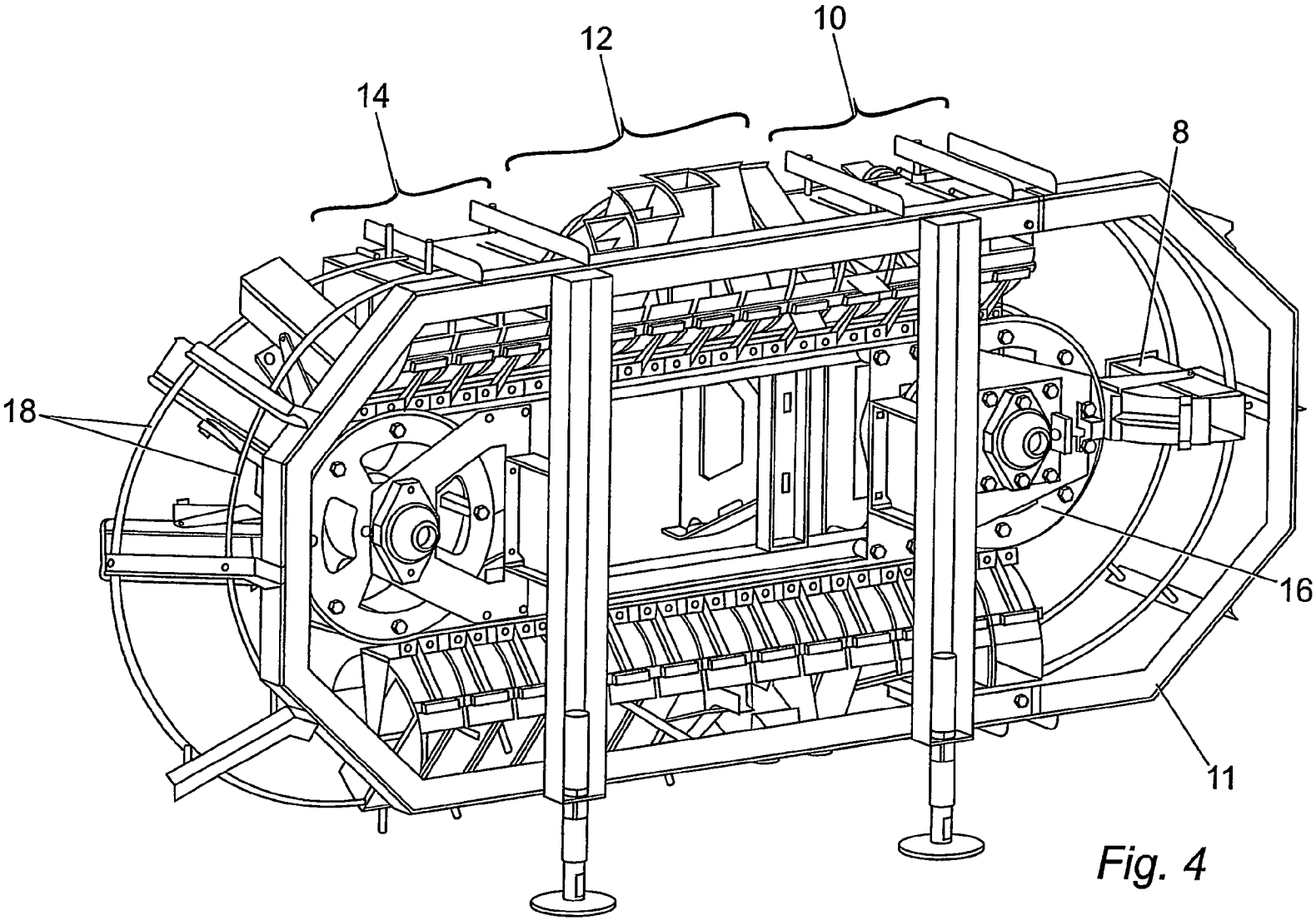
Figure 5:
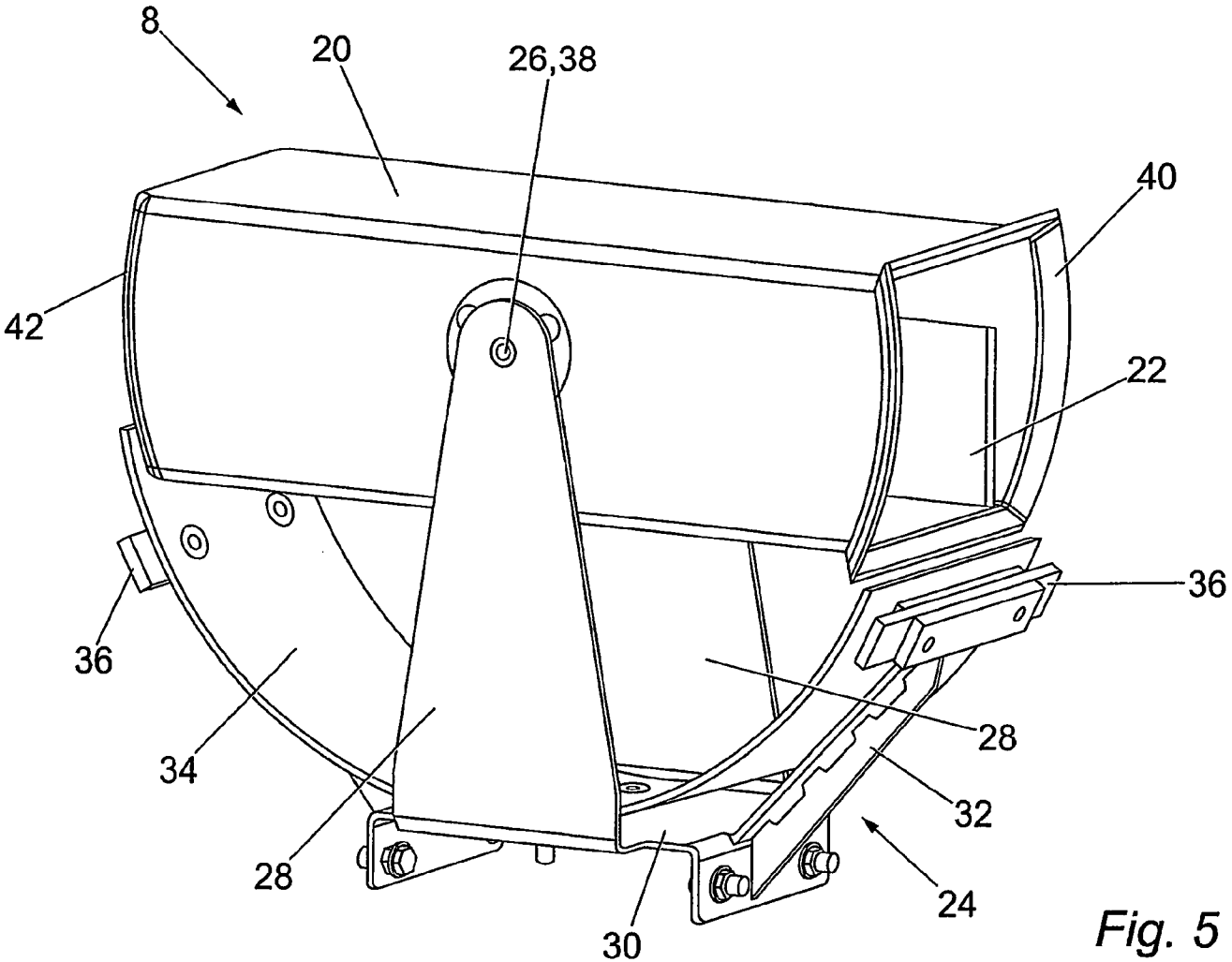

In the following, the invention is described with reference to the drawing which without being limiting shows a preferred embodiment of the turning apparatus according to the invention, where:

FIG. 1 shows a turning apparatus and an object conveyor viewed isometrically from the side, FIG. 2 is identical with FIG. 1 but viewed isometrically from the other side, FIG. 3 shows only the turning apparatus from FIG. 1, isometrically and from the side, FIG. 4 is identical with FIG. 3, but is shown isometrically from the other side as in FIG. 2, and FIG. 5 shows a turning apparatus in detail, also isometrically.

FIGS. 1 and 2 both show the same construction but seen from each side. The design comprises an object conveyor 2 and a turning apparatus 4. The conveyor 2 is seen from the front in FIG. 1 and it is clearly shown that the object trays 6 run in parallel with the turning units 8. The two units 2,4 operate synchronously, and there are in this variant thirteen turning units 8 that are active at the time. The process is operated with four receiving units 10, five units that are being end-turned 12, and finally four units that are returning 14 to the object trays 6. The end-turning process takes place without any reduction in the capacity of the apparatus, and may be adjusted to turning all objects 22 or e.g. every second or third object 22. This has no influence on the capacity whatsoever, irrespective of whether objects 22 are turned or not. FIG. 2 clearly shows that the turning apparatus 4 is a separate unit in parallel with the object conveyor 2. The turning units 8 are seen as a closed circuit in which the upper units are active and the lower units are moving toward renewed filling. The turning apparatus may also be designed as one single unit consisting of both turning unit and object conveyor. Such a unit may be inserted in a traditional conveying apparatus as a separate machine.

FIG. 3 is an enlargement of the turning apparatus 4, where the pulling station 16, which is basically a known construction, is shown. Moreover, the turning units 8 and the guide rails 18 controlling the rotation of the turning units 8 are shown. From this figure, it is clear that the receiving process 10 uses four turning units 8, that the end-turning process 12 uses five units 8, and that the returning process 14 uses the last four active units 8. The turning apparatus 4 may freely be coupled to and from the object conveyor 2 by means not shown. The guide rails 18 that ensure the correct turning of the turning tubes 20 may be seen in both FIG. 3 and FIG. 4. Especially in FIG. 4, it is apparent that the turning tubes 20 are pivoted immediately after the object 22 is returned and the tube 20 is maintained in this position in order to self-empty until immediately before adjustment for renewed filling.

FIG. 5 shows a turning unit 8 in detail. The turning tube 20 is connected to a console 24 by a bearing 26 between the tube 20 and the tube holding arm 28. The tube holding arm 28 extends from the ends of the console foot 30. By the console foot 30, the console 24 is fixed to a pulling station 16 not shown, which is provided with by more clearly means for ensuring the conveying of the turning unit 8. From the sides of the console foot 30, support arms 32 extend to which a replaceable bottom plate 34 is fixed. At the ends of the support arms 32, distance elements 36 are mounted, which ensure that the units 8 are not compressed when they are pushed forward in parallel and synchronously with the object trays 6 on the object conveyor 2. It is apparent from FIG. 5 that the rotation axis 38 is displaced in relation to the middle of the turning tube 20, and that the replaceable bottom plate 34 follows the circle arc defined by the ends 40, 42 of the turning tube 20. Moreover, it is shown that the turning tube 20 is funnel-shaped in design where the receiving end 40 has an enlarged cross-sectional area and the delivery end 42 is tapered.

The invention claimed is:

1. Turning apparatus for end turning objects, preferably ice-cream cones, after selective deflection of the objects from an object conveyor on which the objects are placed lying in horizontal trays, wherein the turning apparatus (4) has selection means, which makes the turning process selective, and means ensuring that the process proceeds in parallel and synchronous with the object conveyor (2), on which objects (22) are forwarded in object trays (6), and where the selection means selects the objects (22) and forward these objects (22) separately across a turning unit (8), where the objects (22) and associated means (8, 16, 18) are turned in the orthogonal plane of the direction of movement about a horizontal axis, which is parallel with the object conveyor (2) and by the use of delivery means are delivered back on the object conveyor (2), preferably in the same object trays (6) as the objects (22) previously were in.

2. Turning apparatus according to claim 1, characterised in that the selection means of the turning apparatus are adapted to selective deflection according to a predetermined pattern, for instance all objects (22), every second or every third object (22) to a turning unit (8).

3. Turning apparatus according to claim 1, characterised in that the turning apparatus (4) is divided into three sections, namely a receiving section (10), an end turning section (12) and a returning section (14), where the end turning is performed gently during coupling to the turning apparatus (8), where the complete installation (2, 4) has a capacity on 300–600 objects/minute.

4. Turning apparatus according to claim 1, characterised in that the turning units (8) are controlled for end turning, wherein the rotation of each turn tube (20) is controlled by fixed guide rails (18), which end turn the tube (20) after it has left a receiving section (10) and before it enters into a delivery section (14), where the turning tube (20) immediately after the passage of a delivery section (14) is controlled by the guide rails (18) to an inclined position and is rotated back to the initial position before returning to the receiving section (10) where the turning tube (20) during the entire cycle is controlled by guide rails (18).

5. Tuning apparatus according to claim 1, characterised in that the turning apparatus (4) comprises means for returning objects (22) to the object conveyor (2) where air under high pressure and an air current drives the object (22) out of the turning unit (8).

6. Turning apparatus according to claim 1, characterised in that the turning apparatus (4) comprises a number of turning units (8) consisting of at least one turning tube (20) where the turn tube (20) is 360° rotatable about its rotation axis (38) and where the turn tube (20) is mounted (26) in a console (24) at points (26) which are displaced relative to the centre line of the tube (20), so that the bottom of the turn tube lays under the level of the bottom of the object tray by the reception of an object (22).

7. Turning apparatus according to claim 6, characterised in that the turn tube (20) is provided with a funnel-shaped receiving end (40) and a tapered delivery end (42).

8. Turning apparatus according to claim 6, characterised in that a turning unit (8) consists of at least one turn tube (20) and at least one console part (24) with a console foot (30) for fastening it to driving means of the pulling station and support arms (32) which extend from the console foot (30) for retention of at least one bottom plate (34) and where a tube holding arm (28) extend from the console (24) connecting the console (24) and the turn tube (20) via a bearing (26).

9. Turning apparatus according to claim 6, characterised in that a turning unit (8) comprises at least one bottom plate (34) which is fastened to the console (24) and to support arms (32) protruding from the console (24) and formed in a shape, which corresponds to the circular arc which is described by the turn tube (20) when it is rotated about its rotation axis (38).

10. Turning apparatus according to claim 1, wherein the selection means performs a selective and gentle sweeping, pushing or deflection of objects (22) into a turnable tube (8), where the deflection occurs by a transverse band that moves in a direction from the object conveyor to the turning unit, on which adjustable band sweeping means for different selection patterns are provided.

* * * * *